US010307326B2

(12) United States Patent
Phillips

(10) Patent No.: US 10,307,326 B2
(45) Date of Patent: Jun. 4, 2019

(54) MULTI-DENSITY MASSAGE BALL

(71) Applicant: IMPLUS FOOTCARE, LLC, Durham, NC (US)

(72) Inventor: Peter L. Cassidy Phillips, Austin, TX (US)

(73) Assignee: IMPLUS FOOTCARE, LLC, Durham, NC (US)

( * ) Notice: Subject to any disclaimer, the term of this patent is extended or adjusted under 35 U.S.C. 154(b) by 604 days.

(21) Appl. No.: 15/062,592

(22) Filed: Mar. 7, 2016

(65) Prior Publication Data

US 2016/0262972 A1 Sep. 15, 2016

Related U.S. Application Data

(60) Provisional application No. 62/130,249, filed on Mar. 9, 2015.

(51) Int. Cl.
*A61H 15/00* (2006.01)
*A61H 39/04* (2006.01)

(52) U.S. Cl.
CPC ..... *A61H 15/0092* (2013.01); *A61H 15/00* (2013.01); *A61H 39/04* (2013.01); *A61H 2015/0064* (2013.01)

(58) Field of Classification Search
CPC ... A63B 37/12; A63B 2037/065; A63B 43/04; A63B 2043/001; A63B 43/002; A63B 37/00; A63B 37/02; A63B 37/04; A63B 37/06; A63B 37/10; A63B 2037/125; A61H 15/00; A61H 2015/0042; A61H 2015/0064
See application file for complete search history.

(56) References Cited

U.S. PATENT DOCUMENTS 3,645,256 A * 2/1972 Morrison ..... A61H 15/00 601/122
4,836,552 A * 6/1989 Puckett ..... A63B 37/0003 273/DIG. 20
5,868,689 A 2/1999 Faroky et al.
5,951,420 A * 9/1999 Talarico ..... A63B 37/06 273/DIG. 8
6,093,159 A 7/2000 Racoosin
(Continued)

FOREIGN PATENT DOCUMENTS

DE 20119764 U1 2/2002
KR 100798271 B1 1/2008
WO 9917843 A1 4/1999

OTHER PUBLICATIONS

Rogue Fitness, "MobilityWOD Supernova", 2010-2015; 7 pages.
(Continued)

*Primary Examiner* — Michael J Tsai
(74) *Attorney, Agent, or Firm* — Buchanan Ingersoll & Rooney PC

(57) ABSTRACT

A massage ball having a plurality of adjacent foam layers including at least one first density foam layer, at least one second density foam layer and at least one third density foam layer, and a glue layer between each adjacent foam layer thereby adhering together the plurality of foam layers. A density of the first density foam layer is different from a density of the second density foam layer which is different from a density of the third density foam layer. The massage ball may also include a solid core in the center thereof.

10 Claims, 6 Drawing Sheets

(56) References Cited

U.S. PATENT DOCUMENTS

| | | | | |
|---|---|---|---|---|
| 6,146,343 | A | 11/2000 | Stewart | |
| 6,241,696 | B1 | 6/2001 | York | |
| 7,156,817 | B1 * | 1/2007 | Cassidy Phillips | A61H 15/0092 601/131 |
| 7,470,203 | B1 * | 12/2008 | Stillinger | A63B 37/12 473/574 |
| 2002/0019268 | A1 * | 2/2002 | Tsunoda | A63B 37/0003 473/351 |
| 2008/0010751 | A1 | 1/2008 | Kemper et al. | |
| 2008/0103421 | A1 * | 5/2008 | Nicholson | A61H 15/0092 601/120 |
| 2010/0144465 | A1 | 6/2010 | Sullivan et al. | |
| 2012/0065557 | A1 | 3/2012 | Phillips | |
| 2013/0196789 | A1 | 8/2013 | Kim et al. | |
| 2014/0256469 | A1 * | 9/2014 | Sullivan | A63B 37/0032 473/373 |
| 2014/0336021 | A1 | 11/2014 | Jones | |
| 2014/0342885 | A1 | 11/2014 | Jones | |
| 2016/0310352 | A1 * | 10/2016 | Chen | A61H 15/02 |

OTHER PUBLICATIONS

Extended European Search Report dated Jul. 12, 2016 in counterpart European Application No. 16159220.9 in the European Patent Office (8 pages).

* cited by examiner

MULTI-DENSITY MASSAGE BALL

TECHNICAL FIELD

The disclosure herein relates to therapeutic body massage devices, such as massage balls, and more particularly, to a multi-density massage ball which substantially mirrors the hardness and deformation characteristics of the human thumb or flesh and is particularly effective in relieving tender and painful conditions such as muscle conditions, including but not limited to trigger points.

BACKGROUND

The art of massage has long been used to relieve various muscle, tendon and other connective tissue ailments. The kneading of muscles, for example, imparts a modification to the muscle tissue that acts beneficially on the nerves, the muscles being controlled by the nerves in both their movement and nourishment, health of the muscle tissue due to improved blood circulation, and effusion of waste material from the muscle and connective tissues. Accordingly, numerous devices are known in the art for massaging muscles or other tissues. A number of patents of interest in this regard include, for example, U.S. Pat. Nos. 5,868,689, 6,093,159, 6,146,343, 6,241,696, and 7,156,817, the contents of which are hereby incorporated by reference.

Tight muscles are a common condition particularly among athletes and other active persons. Tight muscles can be caused by a variety of factors including overuse, in which small micro tears form in the muscles and cause the muscles to tighten. Poor stretching routines, particularly after physical training, may lead to muscle tightness since a muscle may adaptively shorten if it is not regularly stretched to its natural length. Bad posture can also lead to muscle tightness since improper positioning of the head or other body part may increase the work required by the muscles that support the body part.

A "trigger point" is a common type of connective tissue injury which may be caused by conditions including but not limited to long periods of sitting, repetition of movement, poor biomechanics, myofacia accumulation, electrolyte depletion, salt deficiency, or general muscle over-use. A trigger point is a discrete knot or tight, ropy band of muscle that forms when a muscle fails to relax. The knot often can be felt under the skin and may twitch involuntarily when touched. This is known as a "jump sign". Trigger points can trap or irritate nerves surrounding the affected tissue and cause referred pain-pain which originates in one part of the body and is felt in another (such as pain from a heart attack that is felt in the jaw or arm). Scar tissue, loss of range of motion and muscle weakness may occur over time as a result of a trigger point.

Accordingly, it would be desirable to have a message device which is particularly effective in relieving pain and discomfort associated with trigger points as well as other muscle or connective tissue ailments. More particularly, it would be desirable to have a massage device such as a massage ball which has massage zones of various densities to enable a user to control the level and intensity of massage, which mirrors the hardness and deformation characteristics of the flesh on the human thumb or palm, and is capable of hands-free use by an individual.

SUMMARY

The disclosure herein is directed to a massage ball having a plurality of adjacent foam layers including at least one first density foam layer, at least one second density foam layer and at least one third density foam layer; and a glue layer between each adjacent foam layer thereby adhering together the plurality of foam layers. A density of the first density foam layer is different from a density of the second density foam layer which is different from a density of the third density foam layer.

In accordance with a further aspect of the disclosure, a solid core is provided within the center of the massage ball.

BRIEF DESCRIPTION OF THE DRAWING FIGURES

These and other features and advantages of the disclosure will become more readily apparent to those skilled in the art upon reading the following detailed description, in conjunction with the appended drawings in which.

DETAILED DESCRIPTION

Figure 1:
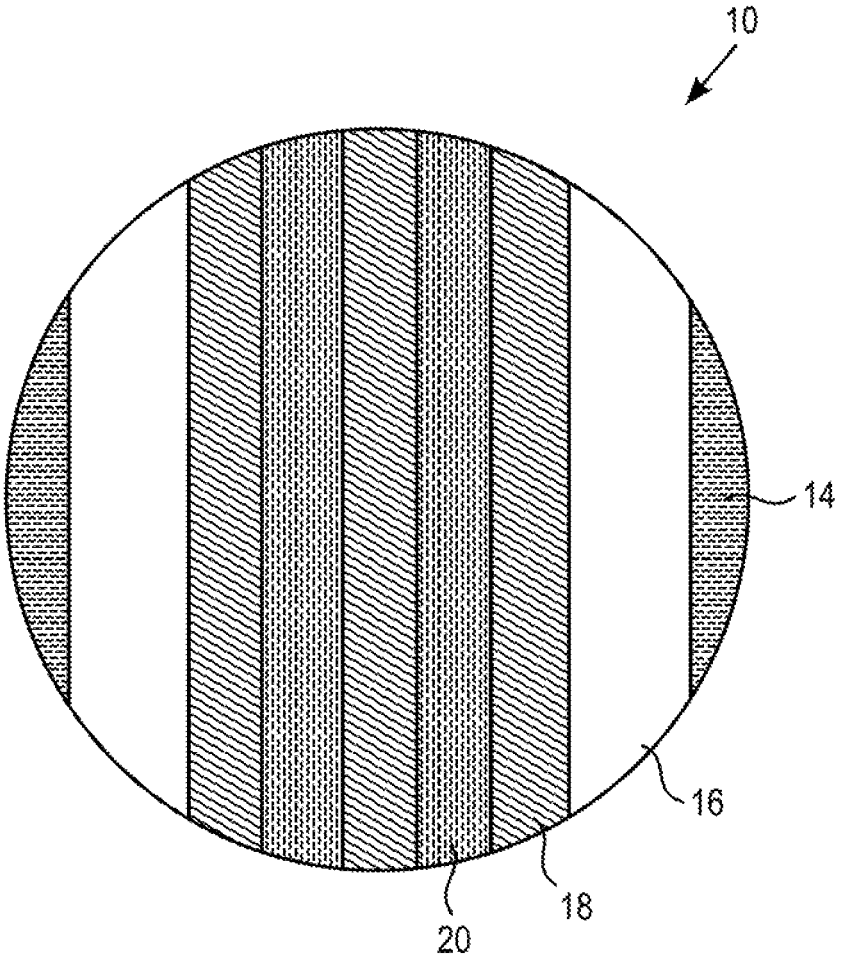
FIG. 1 is a side view of an exemplary embodiment of a massage ball according to the disclosure herein.
Figure 2:
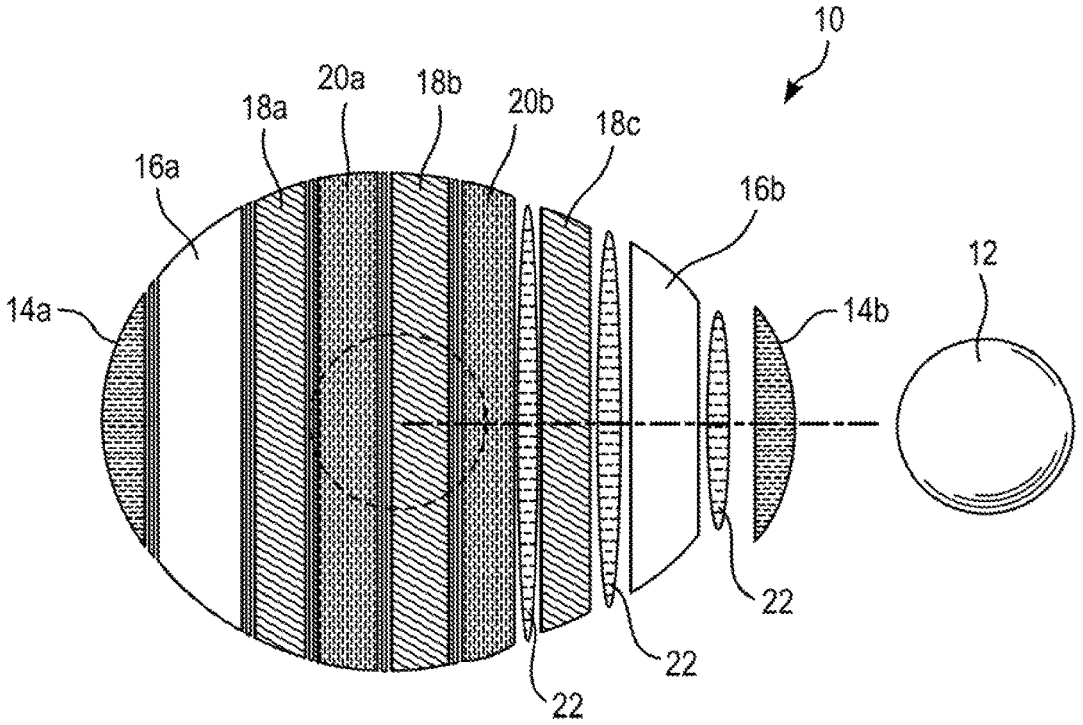
FIG. 2 is an exploded cross-sectional view taken generally along a centerline of the massage ball shown in FIG. 1.
Figure 3:
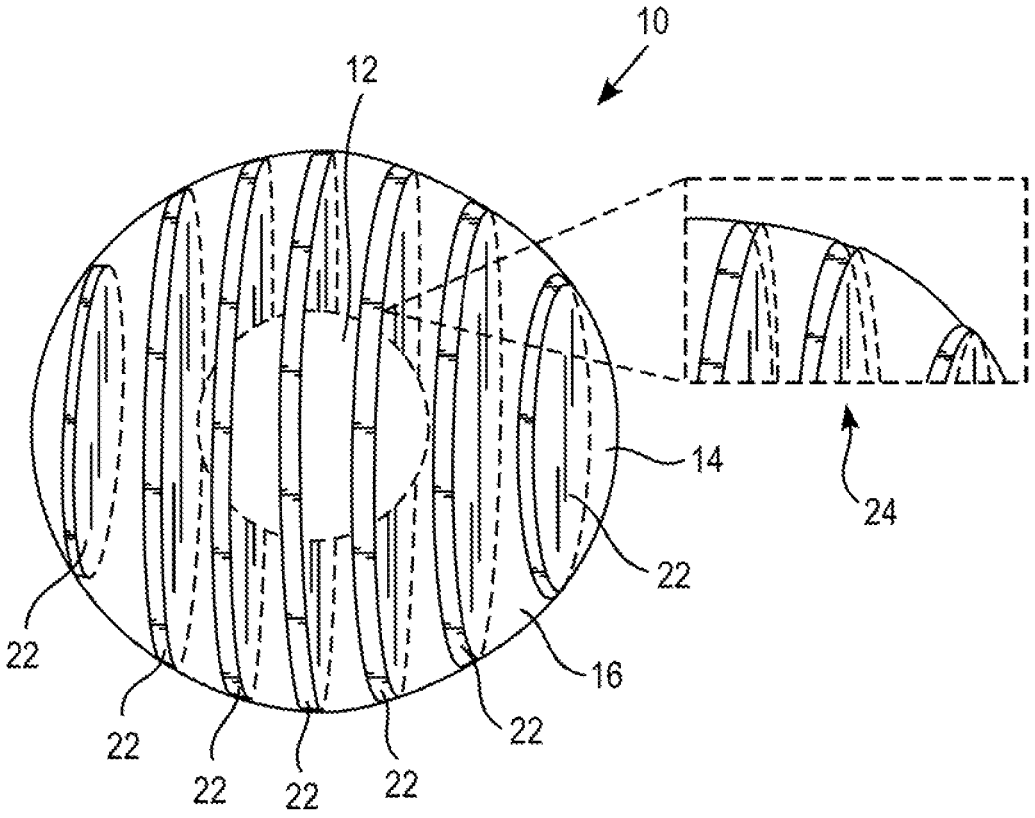
FIG. 3 is a perspective view of the massage ball shown in FIG. 1.

Referring to FIGS. 1-3, a first exemplary embodiment of a massage ball according to the disclosure herein is shown generally by reference numeral 10. Massage ball 10 is preferably spherical in shape and includes a spherical core 12. Massage ball 10 includes at least one first density foam layer 14, at least one second density foam layer 16, at least one third density foam layer 18, and at least one fourth density foam layer 20 forming cross-sectional "slices" of the sphere. A plurality of glue layers 22 holding together the plurality of foam layers 14, 16, 18, 20. When assembled, the massage ball 10 has a diameter of approximately 2-5 inches in the exemplary embodiment, preferably 2-3 inches and more particularly 2.62 inches. These layers impart compression-resistance and deformation characteristics to the massage ball 10 which mirror the compression-resistance and deformation characteristics of the flesh on a human thumb or palm. These characteristics enable the massage ball 10 to function in the same manner as the fingers or hand of a massage therapist in the treatment of muscular or other connective tissue ailments. The massage ball 10 is effective in relieving pain and discomfort associated with a variety of muscle and connective tissue ailments, and may further be used as a tool for the prevention of trigger points and other muscular and connective tissue ailments.

The spherical core 12 of the massage ball 10 may be made from, for example, rubber, wood, foam, solid polyvinylchloride (PVC), or any other known substantially firm, rigid, generally solid material including but not limited to polyurethane, stone, plastic or metal. Typically, in the exemplary embodiment for massage ball 10, the core 12 has a diameter of about 4 cm. The core 12 mirrors the firm or rigid consistency of the bone in the human thumb. The substantially firm or rigid core 12 further functions as a support base which renders the massage ball 10 capable of supporting a substantial compressive load or pressure without excessive deformation, and imparts weight to the massage ball 10 when desired.

Multiple massage zones of various densities are provided in the massage ball 10. By way of example, massage ball 10 includes opposing ends 14*a*, 14*b* of first density foam layer 14, intermediate layers 16*a*, 16*b* of second density foam layer 16, a plurality of central layers 18*a*, 18*b*, 18*c* of third density foam layer 18 alternating with a plurality of layers 20*a*, 20*b* of a fourth density foam layer 20. In the exemplary embodiment, the massage zones may include at least one low-density massage zone defined by fourth density foam layer 20, at least one medium-density massage zone defined by second and/or third density foam layers 16, 18, and at least one high-density massage zone defined by first density foam layer 14. Accordingly, the low-density massage zone is lower in density and softer to the touch than the medium-density massage zone. Likewise, the medium-density massage zone is lower in density and softer to the touch than the high-density massage zone.

In the exemplary embodiment for massage ball 10, opposing ends 14*a*, 14*b* of first density foam layer 14 have a density of 50+/−3 measured with an Asker C durometer, intermediate layers 16*a*, 16*b* of second density foam layer 16 have a density of 70+/−3 measured with an Asker C durometer, central layers 18*a*, 18*b*, 18*c* of third density foam layer 18 have a density of 55+/−3 measured with an Asker C durometer, and layers 20*a*, 20*b* of a fourth density foam layer 20 have a density of 65+/−3 measured with an Asker C durometer. A possible foam material forming the foam layers is ethylene-vinyl acetate (EVA), for example, but other foam polymers and materials could of course also be used.

The plurality of foam layers, 14, 16, 18, 20 are secured together by a layer of glue 22 disposed between the adjacent foam layers. The thickness of the glue layers is chosen such that the glue layers form a rib structure 24 which assists in enhancing circulation during a massage. With reference to FIG. 3, the rib structure 24 brings together the layers 14, 16, 18, 20 of the multiple foam densities to create a systematic approach to blood flow. Each end 14*a*, 14*b* of the massage ball 10 represents an acupressure softness for molding into the body part while also using the textured surface for added comfort and stabilization of the ball. The rigidness of the glue layers 22 allows for structural integrity as the user rolls the ball 10 over the surface of the muscles. Even with additional weight added by core 12, ball 10 will slowly reform back to its original shape. Massage ball 10 is designed to change shape once pressure is applied so that there is continual support to the targeted muscle as the user rolls ball. Contrary to prior massage balls which are ridged and firm and therefor stay on of the muscle, massage ball 10 is absorbed into the muscle. The outer foam surface formed by the plurality of foam layers is designed to feel much like a therapist hand aiding in additional comfort.

The number of foam layers and the thickness of each foam layer are illustrated for the exemplary embodiment of massage ball 10. One skilled in the art will recognize however that fewer layers of foam may be used to achieve satisfactory results in some instances and the thickness of each foam layer may be uniform across massage ball 10 or certain layers may have a greater or lesser thickness depending upon the massage characteristics desired.

It will be also be appreciated by those skilled in the art that the densities of the foam layers forming the low-density massage zones, the medium-density massage zones and the high density massage zones on the massage ball 10 may be varied as desired so as to enable a user to achieve a high degree of selectivity and control in the level, intensity and location of the massaging action which is imparted by the massage ball 10 against the user's selected area of the body.

Likewise, one skilled in the art will recognize that the overall diameter and size of the massage ball may also be varied to meet various needs of a user. For example, a larger massage ball having a diameter of five inches is also possible, as would be any other diameter.

Figure 4:
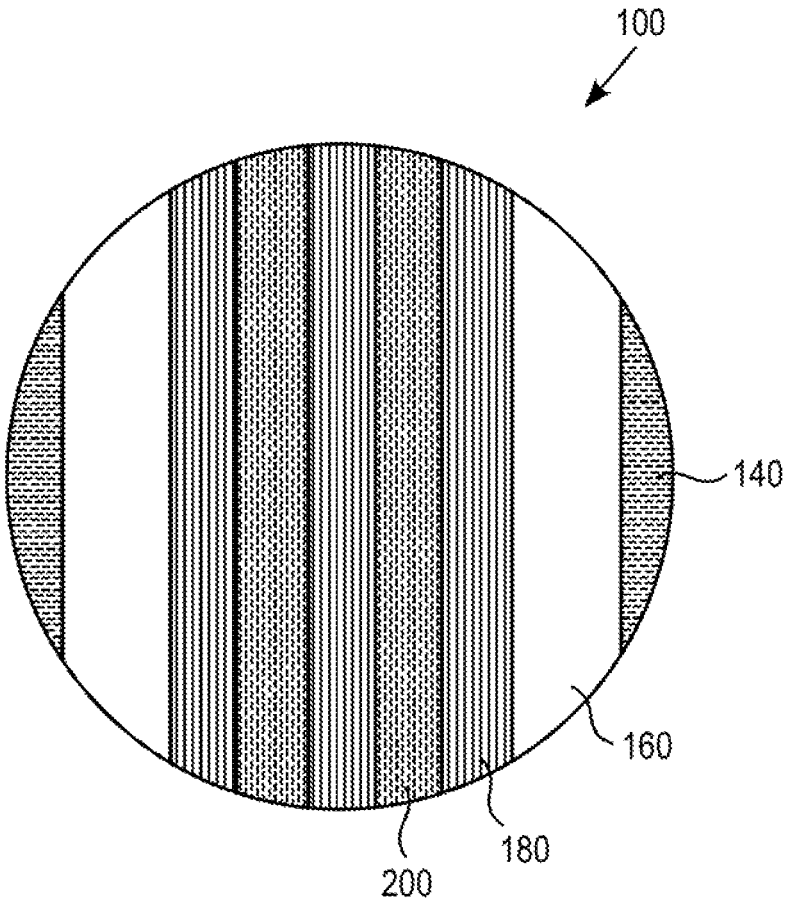
FIG. 4 is a side view of a further exemplary embodiment of a massage ball according to the disclosure herein.
Figure 5:
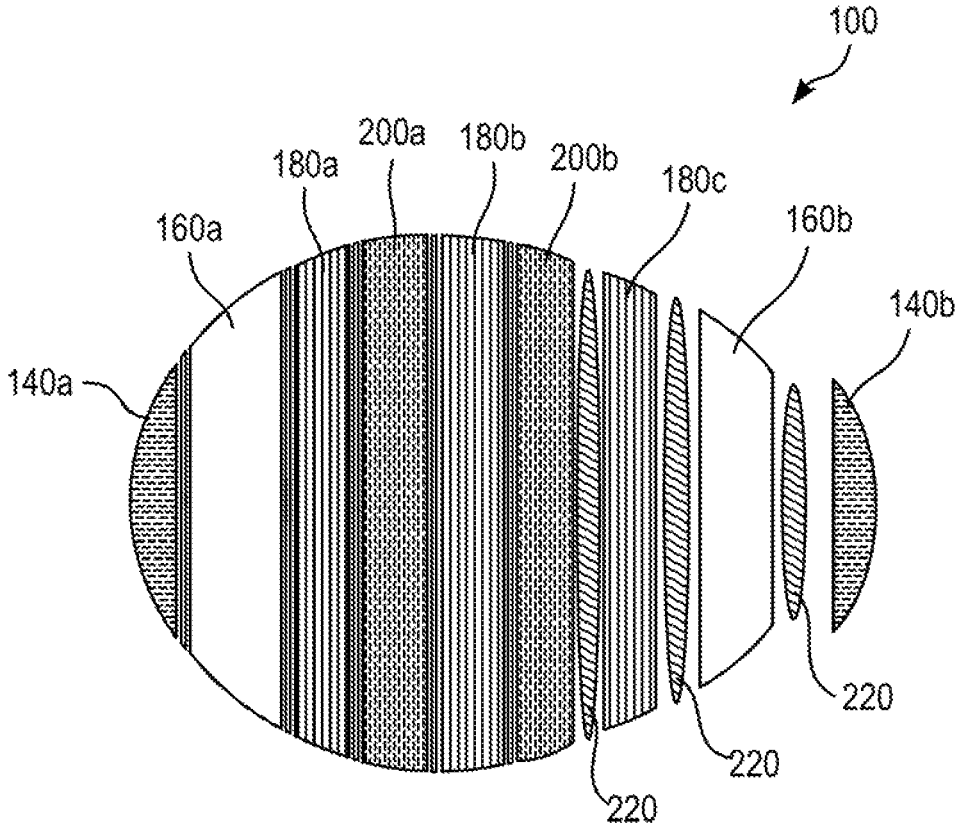
FIG. 5 is an exploded cross-sectional view taken generally along a centerline of the massage ball shown in FIG. 4.
Figure 6:
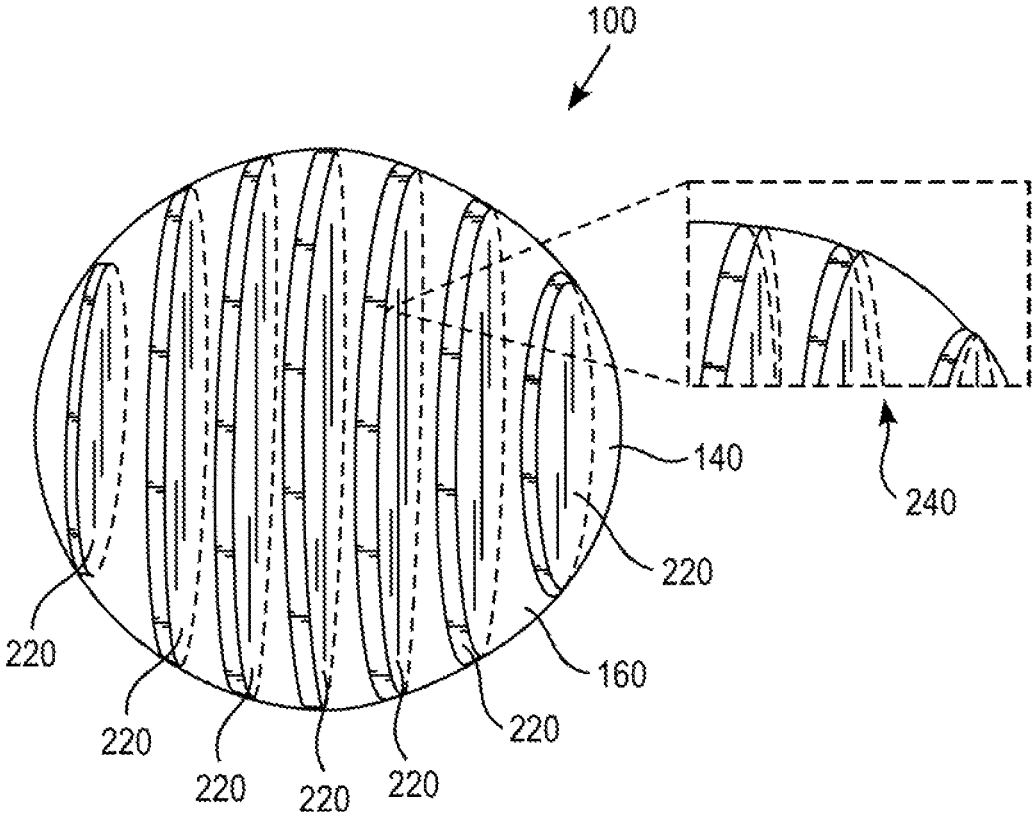
FIG. 6 is a perspective view of the massage ball shown in FIG. 4.

Referring next to FIGS. 4-6, a second exemplary embodiment of a massage ball according to the disclosure herein is shown generally by reference numeral 100. Massage ball 100 includes at least one first density foam layer 140, at least one second density foam layer 160, at least one third density foam layer 180, at least one fourth density foam layer 200, and a plurality of glue layers 220 holding together the plurality of foam layers 140, 160, 180, 200. When assembled, the massage ball 100 has a diameter of approximately 2-5 inches in the exemplary embodiment, preferably 2-3 inches and more particularly 2.62 inches. These layers impart compression-resistance and deformation characteristics to the massage ball 100 which mirror the compression-resistance and deformation characteristics of the flesh on a human thumb or palm. These characteristics enable the massage ball 100 to function in the same manner as the fingers or hand of a massage therapist in the treatment of muscular or other connective tissue ailments. The massage ball 100 is effective in relieving pain and discomfort associated with a variety of muscle and connective tissue ailments, and may further be used as a tool for the prevention of trigger points and other muscular and connective tissue ailments.

Multiple massage zones of various densities are provided in the massage ball 100. By way of example, massage ball 100 includes opposing ends 140*a*, 140*b* of first density foam layer 140, intermediate layers 160*a*, 160*b* of second density foam layer 160, a plurality of central layers 180*a*, 180*b*, 180*c* of third density foam layer 180 alternating with a plurality of layers 200*a*, 200*b* of a fourth density foam layer 200. In the exemplary embodiment, the massage zones may include at least one low-density massage zone defined by fourth density foam layer 200, at least one medium-density massage zone defined by second and/or third density foam layers 160, 180, and at least one high-density massage zone defined by first density foam layer 140. Accordingly, the low-density massage zone is lower in density and softer to the touch than the medium-density massage zone. Likewise, the medium-density massage zone is lower in density and softer to the touch than the high-density massage zone.

In the exemplary embodiment for massage ball 100, opposing ends 140*a*, 140*b* of first density foam layer 140 have a density of 50+/−3 measured with an Asker C durometer, intermediate layers 160*a*, 160*b* of second density foam layer 160 have a density of 80+/−3 measured with an Asker C durometer, central layers 180*a*, 180*b*, 180*c* of third density foam layer 180 have a density of 60+/−3 measured with an Asker C durometer, and layers 200*a*, 200*b* of a fourth density foam layer 200 have a density of 70+/−3 measured with an Asker C durometer. A possible foam material forming the foam layers is ethylene-vinyl acetate (EVA), for example, but other foam polymers and materials could of course also be used.

The plurality of foam layers, 140, 160, 180, 200 are secured together by a layer of glue 220 disposed between the adjacent foam layers. The thickness of the glue layers is chosen such that the glue layers form a rib structure 240 which assists in enhancing circulation during a massage.

With reference to FIG. 6, the rib structure 240 brings together the layers 140, 160, 180, 200 of the multiple foam densities to create a systematic approach to blood flow. Each end 140*a*, 140*b* of the massage ball 100 represents an acupressure softness for molding into the body part while also using the textured surface for added comfort and stabilization of the ball. The rigidness of the glue layers 220 allows for structural integrity as the user rolls the ball 100 over the surface of the muscles. Massage ball 100 is designed to change shape once pressure is applied so that there is continual support to the targeted muscle as the user rolls ball. Contrary to prior massage balls which are ridged and firm and therefor stay on of the muscle, massage ball 100 is absorbed into the muscle. The outer foam surface formed by the plurality of foam layers is designed to feel much like a therapist hand aiding in additional comfort.

The number of foam layers and the thickness of each foam layer are illustrated for the exemplary embodiment of massage ball 100. One skilled in the art will recognize however that fewer layers of foam may be used to achieve satisfactory results in some instances and the thickness of each foam layer may be uniform across massage ball 100 or certain layers may have a greater or lesser thickness depending upon the massage characteristics desired.

It will be also be appreciated by those skilled in the art that the densities of the foam layers forming the low-density massage zones, the medium-density massage zones and the high density massage zones on the massage ball 100 may be varied as desired so as to enable a user to achieve a high degree of selectivity and control in the level, intensity and location of the massaging action which is imparted by the massage ball 100 against the user's selected area of the body.

Likewise, one skilled in the art will recognize that the overall diameter and size, as well as the shape, of the massage ball may also be varied to meet various needs of a user. For example, a larger massage ball having a diameter of five inches is also possible, as would be any other diameter.

In a typical application, the massage ball 10, 100 is used to relieve pain and discomfort associated with trigger points, spasms and other muscular ailments. Accordingly, in the event that a deltoid muscle of a user is afflicted with pain or discomfort caused by a trigger point and/or muscle spasm, for example, the user initially presses the massage ball 10, 100 against the region adjacent to his or her shoulder beneath which the afflicted muscle lies, using his or her hand. After several seconds of continuous and steady pressure, the massage ball 10, 100 gradually deforms to change shape and generally conform to the configuration of the surface on the shoulder against which the massage ball 10, 100 is pressed. Accordingly, the massage ball 10, 100 applies pressure which penetrates the belly of the afflicted muscle without damaging the muscle tissue. As the massage ball 10, 100 thus changes shape, the user rolls the ball around on the affected area in a generally circular or back-and-forth motion while continuing to apply pressure against the massage ball 10, 100 using the hand. This pressure applied to the affected area by the massage ball 10, 100 increases flow of oxygenated blood or blood and oxygen to the muscle afflicted with the trigger point and/or spasms, creating elasticity in the belly of the muscle and relieving the associated pain and discomfort. This procedure is applied as often as is necessary to relieve the pain and discomfort and eliminate the condition. It will be appreciated by those skilled in the art that repeated use of the massage ball 10, 100 in the manner heretofore described is effective not only in relieving the pain and discomfort associated with trigger points, spasms or other muscular afflictions, but also in preventing additional occurrences of the pain or discomfort. It will be further appreciated that the massage ball 10, 100 provides a safe and effective way for a person to manipulate muscle or connective tissue on his or her own, without requiring the manual kneading action of a massage therapist.

While the disclosure herein has been described with respect to exemplary embodiments of the disclosure, this is by way of illustration for purposes of disclosure rather than to confine the invention to any specific arrangement as there are various alterations, changes, deviations, eliminations, substitutions, omissions and departures which may be made in the particular embodiment shown and described without departing from the scope of the present invention.

What is claimed is:

1. A massage ball comprising:

a plurality of adjacent foam layers including at least one first density foam layer, at least one second density foam layer, at least one third density foam layer, and at least one fourth density foam layer;

a glue layer between each adjacent foam layer thereby adhering together said plurality of foam layers;

wherein a density of the first density foam layer is different from a density of the second density foam layer which is different from a density of the third density foam layer;

wherein a hardness of the at least one first density foam layer is greater than a hardness of the at least one second density foam layer;

wherein the hardness of the at least one second density foam layer is greater than a hardness of the at least one third density foam layer;

wherein the hardness of the at least one third density foam layer being greater than a hardness of the at least one fourth density foam layer;

wherein the at least one first density foam layer includes two first density foam layers defining opposed end surfaces of the massage ball;

wherein the at least one second density foam layer includes two second density foam layers disposed adjacent the first density foam layers; and wherein the at least one third density foam layer includes three third density foam layers and the at least one fourth density foam layer includes two fourth density foam layers, the third density foam layers and the fourth density foam layers forming alternating central layers in the massage ball.

2. The massage ball according to claim 1, further comprising a solid core within a center of the massage ball.

3. The massage ball according to claim 2, wherein said solid core is made from a rubber material.

4. The massage ball according to claim 1, wherein said glue layers define a rib structure between said plurality of foam layers.

5. The massage ball according to claim 1, wherein the massage ball is spherical.

6. A therapeutic body massage device, comprising:

a plurality of adjacent foam layers including at least one first density foam layer, at least one second density foam layer, at least one third density foam layer, and at least one fourth density foam layer;

a glue layer between each adjacent foam layer thereby adhering together said plurality of foam layers;

wherein a density of the first density foam layer is different from a density of the second density foam layer which is different from a density of the third density foam layer;

wherein a hardness of the at least one first density foam layer is greater than a hardness of the at least one second density foam layer;

wherein the hardness of the at least one second density foam layer is greater than a hardness of the at least one third density foam layer;

wherein the hardness of the at least one third density foam layer being greater than a hardness of the at least one fourth density foam layer;

wherein the at least one first density foam layer includes two first density foam layers defining opposed end surfaces of the therapeutic body massage device;

wherein the at least one second density foam layer includes two second density foam layers disposed adjacent the first density foam layers; and wherein the at least one third density foam layer includes three third density foam layers and the at least one fourth density foam layer includes two fourth density foam layers, the third density foam layers and the fourth density foam layers forming alternating central layers in the therapeutic body massage device.

7. The therapeutic body massage device according to claim 6, further comprising a solid core within a center of the therapeutic body massage device.

8. The therapeutic body massage device according to claim 7, wherein said solid core is made from a rubber material.

9. The therapeutic body massage device according to claim 6, wherein said glue layers define a rib structure between said plurality of foam layers.

10. The therapeutic body massage device according to claim 6, wherein the therapeutic body massage device is spherical.

* * * * *